US006298585B1

(12) United States Patent
Boulet

(10) Patent No.: US 6,298,585 B1
(45) Date of Patent: Oct. 9, 2001

(54) WING ACCESSORY FOR USE ON THE BUCKET OF A LOADER

(75) Inventor: Edmond E. Boulet, Somerset (CA)

(73) Assignee: Boulet Brothers Concrete Ltd., Somerset ( * ) Notice: Subject to any disclaimer, the term of this patent is extended or adjusted under 35 U.S.C. 154(b) by 0 days.

(21) Appl. No.: 09/628,142

(22) Filed: Jul. 28, 2000

(51) Int. Cl.[7] ..... E01H 5/06

(52) U.S. Cl. ..... 37/903; 37/264; 37/281; 172/817

(58) Field of Search ..... 37/280, 281, 266, 37/264, 274, 241, 403, 903, 231; 414/912, 722, 724; 172/817

(56) References Cited

U.S. PATENT DOCUMENTS

| | | | | |
|---|---|---|---|---|
| 2,556,592 | * | 6/1951 | Markkula | 214/140 |
| 2,763,944 | * | 9/1956 | Magee et al. | 37/280 |
| 2,863,233 | * | 12/1958 | Johnson | 37/403 |
| 3,089,261 | * | 5/1963 | Flath | 37/118 |
| 3,286,377 | * | 11/1966 | Long | 37/118 |
| 3,792,539 | * | 2/1974 | Clark | 37/118 |
| 4,043,061 | * | 8/1977 | Heitman | 37/141 |
| 4,145,825 | * | 3/1979 | Bertolino | 37/42 |
| 4,208,814 | * | 6/1980 | Stone | 37/403 |
| 4,275,514 | * | 6/1981 | Maura | 37/281 |
| 4,707,936 | | 11/1987 | Steinhoff . | |
| 4,741,116 | | 5/1988 | Engle et al. . | |
| 4,813,164 | | 3/1989 | Morrell . | |
| 5,129,169 | | 7/1992 | Aubichon . | |
| 5,297,351 | * | 3/1994 | Cote | 37/232 |
| 5,377,766 | * | 1/1995 | Klinger | 172/782 |
| 5,815,957 | * | 10/1998 | McKeown | 37/280 |
| 5,894,689 | * | 4/1999 | Turk | 37/281 |

* cited by examiner

*Primary Examiner*—Thomas B. Will
*Assistant Examiner*—Kristine Markovich
(74) *Attorney, Agent, or Firm*—Ryan W. Dupvis; Adrian D. Battison; Michael R. Williams

(57) ABSTRACT

A wing accessory is provided for mounting on each end of a bucket of a front end loader. The accessory comprises a wing which includes a frame having hooks for extending over the front edge of the bucket and a coupling for securement with fasteners to the back side of the bucket. The wing further includes a panel which is supported to extend laterally outward from the front end of the bucket by a pair of struts coupled to the frame to increase the overall width of the bucket. This is particularly useful when using the bucket for collecting loose material from a given area, for example in the removal of snow.

15 Claims, 3 Drawing Sheets

WING ACCESSORY FOR USE ON THE BUCKET OF A LOADER

FIELD OF THE INVENTION

The present invention relates to an accessory for a loader and more particularly to a wing which is arranged to be mounted on the end of a bucket of a front end loader.

BACKGROUND

It is a known practice for work vehicles such as a front end loader to be used in place of a scraper for moving loose materials, for example snow in colder climates. These vehicles however are normally intended for scooping earth and the like and are not well suited for collecting loose materials similarly to a scraper as required in snow removal for example.

U.S. Pat. No. 5,129,169 to Aubichon provides an attachment for use on vehicles equipped with a bucket. The attachment includes a pair of side members which are arranged to extend generally forward from the respective ends of the bucket and a frame which is coupled therebetween for mounting the side members on the bucket to increase the volumetric capacity of the bucket. A pair of mounting hooks must be welded onto the bucket in order to support the attachment thereon. The task of welding however is expensive and not readily available to persons having only conventional tools. Furthermore, the frame extends between respective inner faces of the side members and is required to extend at least partially in front of the opening of the bucket in order to adequately support the side members. In this arrangement, the frame obstructs the accumulation of material between the side members, while further limiting the spacing therebetween such that the attachments cannot be adapted to different size buckets.

SUMMARY

According to the present invention there is provided an accessory for a loader bucket having an open front side and a back side, the accessory comprising:

a wing;

hook means mounted on the wing for engaging over a front edge of the bucket adjacent the open front side; and fastener means mounted on the wing for fastening the wing to the back side of the bucket.

The wing increases the overall plowing width of the loader bucket which is useful for reducing the number of passes required when using a loader to collect material from a given area. The use of hook means and fastener means allows the wing to be mounted on the bucket of a loader with minimal or no modifications to the bucket, requiring only the use of conventional tools to secure a single bolt onto the bucket.

The wing may include a frame extending longitudinally from a front end mounting the hook means thereon to a rear end mounting the fastener means thereon and a panel extending transversely to the frame so as to extend laterally outward from the bucket when the frame is mounted thereon.

The hook means may comprise a pair of hooks mounted one spaced above the other, each hook being arranged to extend over the front edge of the bucket adjacent one end of the bucket.

The hooks are preferably mounted on a front side of the wing such that the wing is arranged to extend laterally outward from the front side of the bucket.

The fastener means may comprise an aperture in the wing arranged to align with an aperture in the bucket for receiving a fastener therethrough.

Preferably the aperture in the wing is spaced rearward from a front face of the wing.

At least one strut member is preferably mounted between the frame and the panel.

There may be provided a pair of the strut members mounted spaced one above the other between the frame and the panel.

The strut members are preferably mounted at an inner end on the frame of the wing to extend laterally outward at a forward incline to an outer end mounted on a free end of the panel.

The panel may extend laterally outward at a forward incline from the front end of the frame.

The panel may further be inclined rearwardly from a bottom end to a top end thereof in relation to the frame.

There may be provided an end plate mounted on the free end of the panel to extend forwardly therefrom, the end plate being oriented to lie substantially parallel to the frame.

BRIEF DESCRIPTION OF THE DRAWINGS

In the accompanying drawings, which illustrate an exemplary embodiment of the present invention.

DETAILED DESCRIPTION

Figure 1:
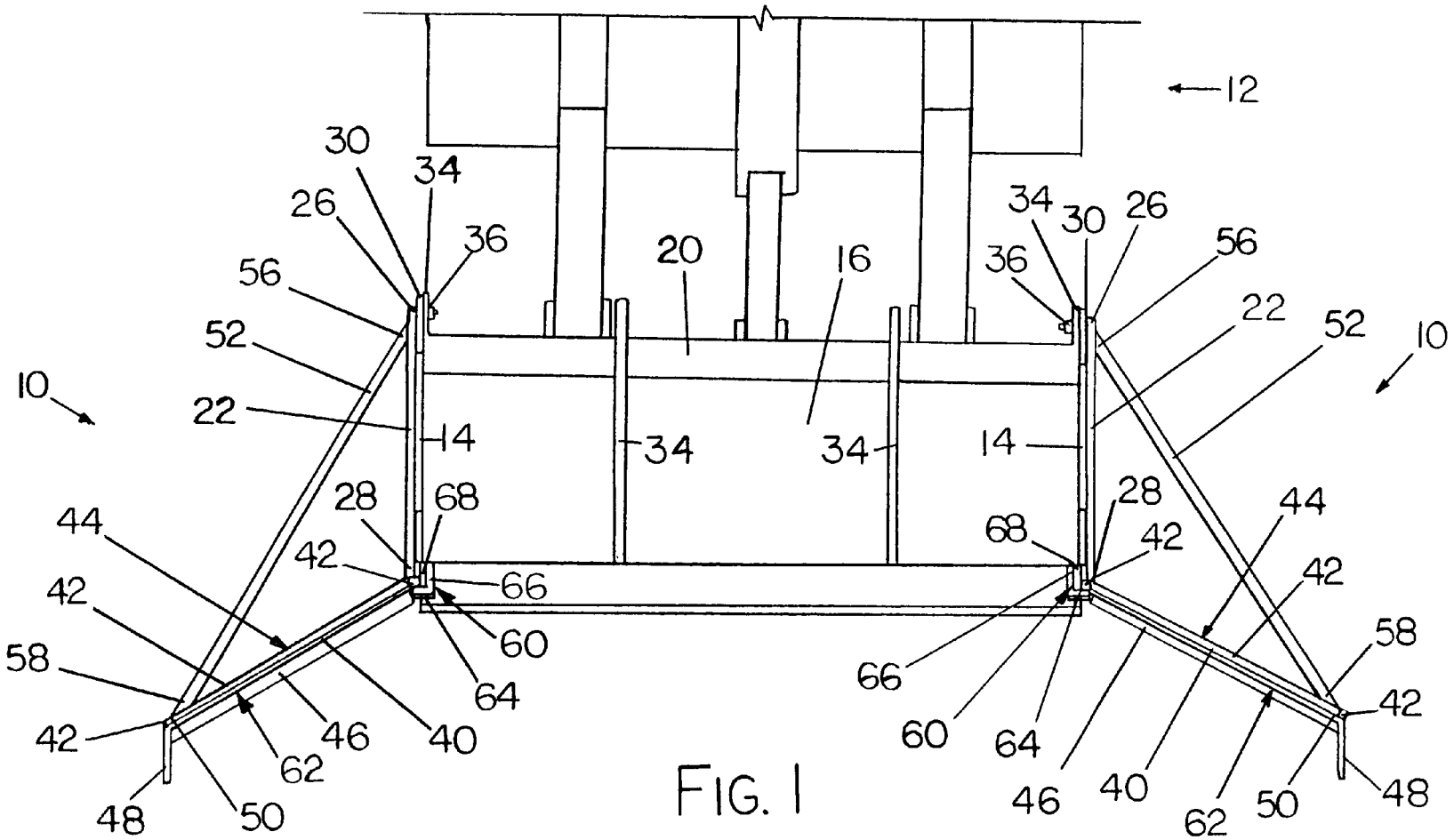
FIG. 1 is a top plan view of a pair of wing accessories shown mounted on respective ends of a bucket of a front end loader.
Figure 2:
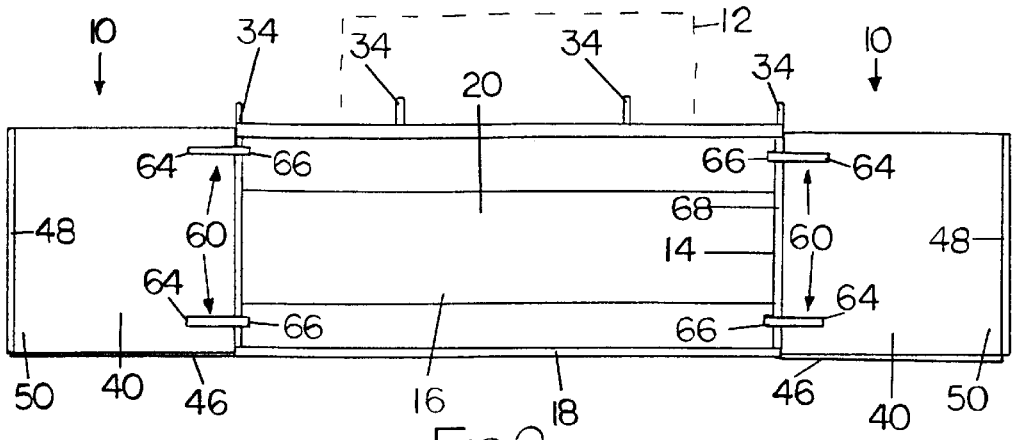
FIGS. 2 and 3 are respective front and side elevational views of the accessories according to FIG. 1.
Figure 3:
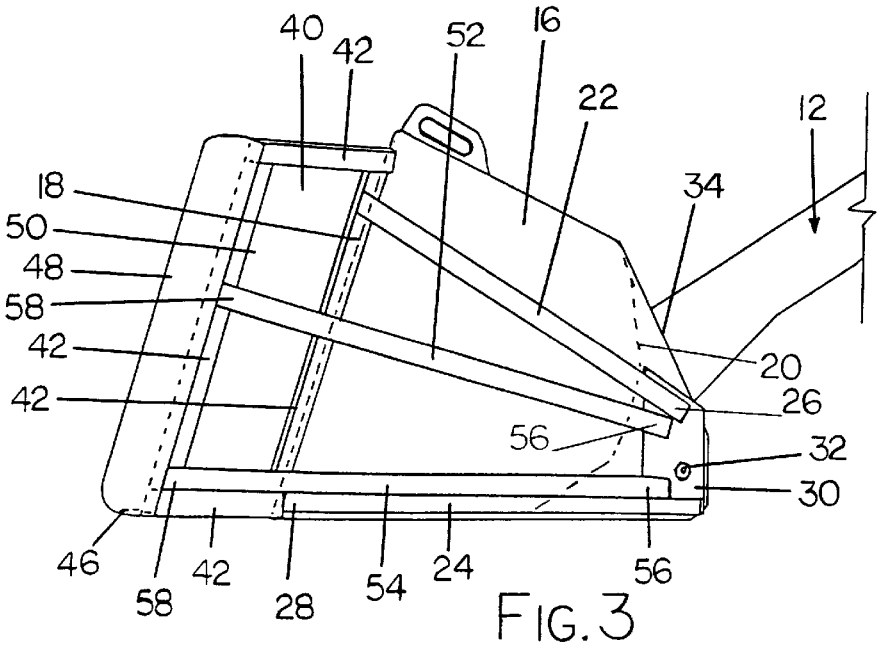
Figure 4:
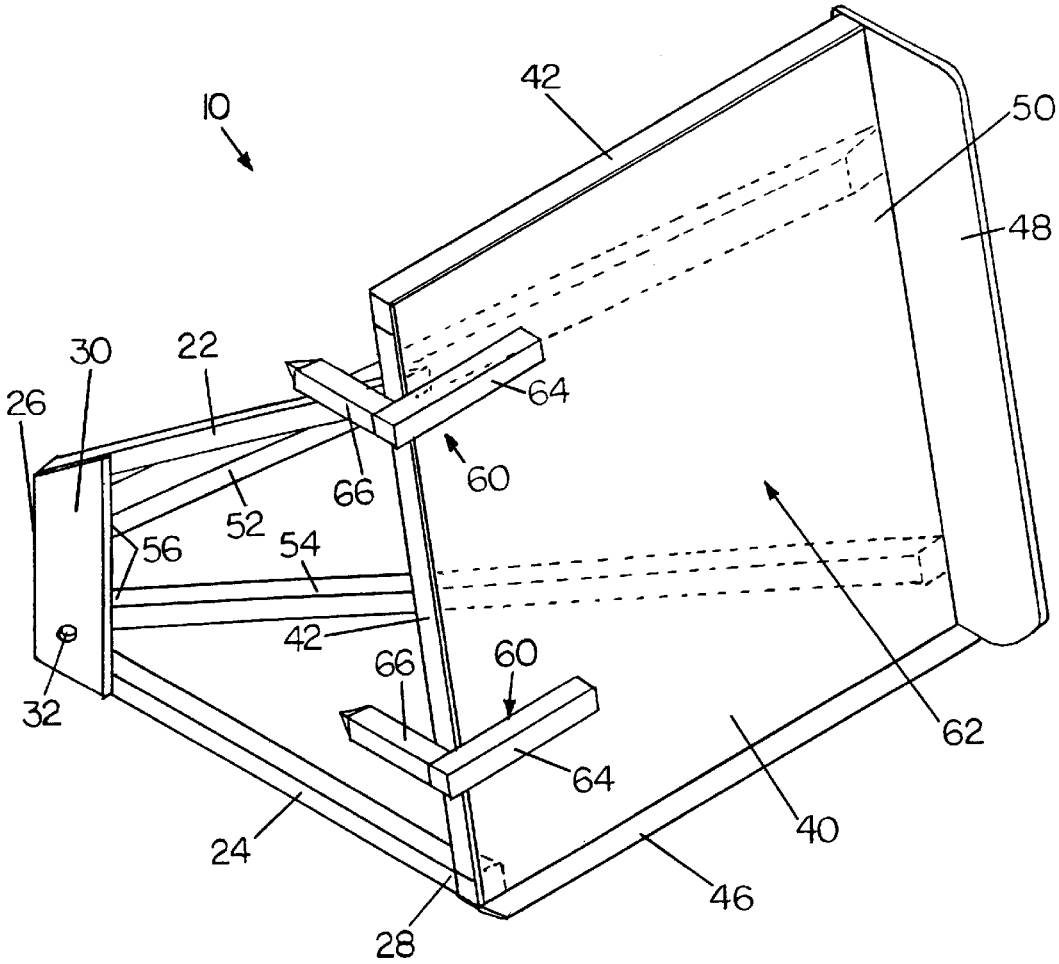
FIG. 4 is an isometric view of one of the wing accessories according to the present invention shown removed from the bucket.

Referring to the accompanying drawings, there is illustrated a wing accessory which is generally indicated by reference numeral 10. The wing accessory 10 provides a front end loader 12 with a wider plowing surface for collecting loose material in a given area with fewer passes of the loader required over the area.

The wing accessory 10 is arranged to mount on either end 14 of a bucket 16 of the front end loader 12 which has a pair of lift arms supporting the bucket thereon. The bucket 16 generally includes an open front side 18 and a base 20 on a rear side thereof with end walls being located at each end 14 of the bucket. The base 20 of the bucket supports the bucket on the lift arms of the loader 12.

A frame is provided comprising an upper frame element 22 and a lower frame element 24. The upper and lower frame elements 22 and 24 are spaced one above the other in a common vertical plane to extend longitudinally from a rear end 26 to a front end 28. The rear ends of the upper and lower frame elements are connected by a rear brace plate 30 which is generally rectangular in shape and spans upwardly between the two frame elements.

The rear brace plate 30 includes a fastener receiving aperture 32 which is arranged to receive a bolt therethrough for coupling the rear end of the frame to the base 20 of the bucket. The bucket 16 includes a plurality of ribs 34 which extend rearwardly from each end of the bucket as well as numerous positions spaced therebetween. The rib 34 on the corresponding end of the bucket mounting the accessory thereon includes a mounting aperture 36 therein for alignment with the fastener receiving aperture 32 on the rear brace plate such that the rear brace plate may be bolted to the rib 34 by inserting a bolt therethrough.

A wing is provided in the form of a panel-like member 40 which mounts on the front end 28 of the frame to extend generally laterally outward therefrom. The panel 40 is a rectangular rigid sheet having panel supports 42 on a rearward mounting face 44 thereof. The panel supports 42 extend across respective top and bottom ends of the panel as well as along the respective sides thereof. The front end 28 of the frame is welded to one of the panel supports 42 extending along a side of the panel such that the panel extends outward therefrom transversely to the longitudinal direction of the frame.

The panel 40 is oriented to extend laterally outwardly at a forward incline from an inner end to an outer end thereof while also being oriented to extend at a rearward incline from the bottom end to the top end of the panel to optimise the accumulation of material thereon in use.

A scrap plate 46 mounts on the bottom end of the panel to extend longitudinally outward therewith. The scrape plate 46 is a rigid rectangular flange which extends forwardly from the bottom end of the panel 40 to improve the wear characteristics thereof.

An end plate 48 is mounted on a free end 50 of the panel 40 to extend generally forwardly therefrom. The end plate 48 is a rigid plate which is generally rectangular in shape and oriented substantially parallel to the frame of the accessory.

An upper strut 52 and a lower strut 54 are mounted between the frame and the panel 40 to provide additional support to the panel. The upper and lower struts are mounted one above the other to extend outwardly at a forward incline from respective inner ends 56 mounted on the rear brace plate 30 to respective outer ends 58 mounted on the panel support 42 on the free end 50 of the panel.

A pair of hooks 60 are mounted on the front face 62 of the panel adjacent the front end 28 of the frame. The hooks 60 are spaced one above the other for securing the front end 28 of the frame to the bucket 16. Each hook 60 includes a mounting portion 64 which extends laterally inwardly from the front face 62 of the panel and an engaging portion 66 which extends rearwardly from the free end of the mounting portion 64. The engaging portion 66 is thus parallel and spaced inwardly from the frame of the accessory so as to clamp the front edge 68 of the corresponding end wall of the bucket therein. The engaging portion further includes a tapered free end to assist in engaging the hooks onto a corresponding end of the bucket.

The front face 62 of the panel is flat and substantially free of obstructions with the exception of the hooks, due to the mounting arrangement of the struts on the rear face thereof. This arrangement provides minimal obstruction to the accumulation of loose material on the front face of the panel.

In use the wing accessory 10 is mounted on each end of the bucket 16 to increase the overall plowing width of the bucket when used for collecting or clearing a given area of loose material, for example snow. The accessory is arranged to be selectively mounted on the bucket with minimal or no modifications being required to the bucket itself.

In order to mount the accessory 10 on the bucket, the bucket is first aligned with the hooks 60 and advanced between the engaging portion 66 of the hooks and the front end 28 of the frame such that the front edge of the corresponding end wall of the bucket is engaged therein. The rear brace plate 30 is subsequently aligned with the rib 34 on the end of the bucket such that a bolt may be inserted through the co-operating fastener receiving aperture 32 and the mounting aperture 36 for bolting the rear end 26 of the frame to the base 20 of the bucket.

The engagement of the mounting portion 64 of the hooks against the front edge 68 of the end wall of the bucket as well as the orientation of the upper and lower struts which are welded to the frame ensure that the bolt securing the rear brace plate 30 to the base of the bucket is subjected to minimal sheer loads. The wing accessory 10 may thus be readily mounted on each end of a conventional bucket 16 of a front end loader 12 using only conventional tools while providing a strong and durable mounting arrangement.

While one embodiment of the present invention has been described in the foregoing, it is to be understood that other embodiments are possible within the scope of the invention. The invention is to be considered limited solely by the scope of the appended claims.

What is claimed is:

1. An accessory arranged for use with a bucket of a loader having an open front side, a back side and a pair of ends, the accessory comprising:

a wing including a frame extending from a front end arranged to be supported on the end of a bucket adjacent the open front side of the bucket to a rear end arranged to be supported on the end of the bucket adjacent the back side of the bucket and a panel extending transversely to the frame adjacent the front end of the frame and being arranged to extend laterally outward from the end of the bucket to a free end of the panel when the frame is supported on the bucket;

hook means mounted on the wing adjacent the front end of the frame and being arranged to extend over the end of the bucket adjacent the open front side of the bucket;

fastener means mounted on the wing and being arranged to fasten the wing to the back side of the bucket; and at least one strut member mounted at an inner end on the frame of the wing to extend laterally outward at a forward incline to an outer end mounted on the free end of the panel.

2. The accessory according to claim 1 wherein the hook means comprises a pair of hooks mounted one spaced above the other, each hook being arranged to extend over a front edge of the bucket adjacent one end of the bucket.

3. The accessory according to claim 1 wherein the hook means is mounted on a front side of the wing such that the wing is arranged to extend laterally outward from the open front side of the bucket.

4. The accessory according to claim 1 wherein the fastener means comprises an aperture in the frame of the wing being arranged to receive a fastener therethrough for securement to the bucket.

5. The accessory according to claim 4 wherein the aperture in the frame of the wing is spaced rearward from a front face of the wing.

6. The accessory according to claim 1 wherein there is provided a pair of the strut members mounted spaced one above the other between the frame and the panel.

7. The accessory according to claim 1 wherein the panel extends laterally outward at a forward incline from the front end of the frame.

8. The accessory according to claim 1 wherein the panel is inclined rearwardly from a bottom end to a top end thereof in relation to the frame.

9. The accessory according to claim 1 wherein there is provided an end plate mounted on the free end of the panel to extend forwardly therefrom, the end plate being oriented to lie substantially parallel to the frame.

10. An accessory in combination with a bucket of a loader having an open front side, a back side and a pair of ends, the accessory comprising:

a wing arranged to be supported on the end of a bucket adjacent the open front side of the bucket to extend laterally outward from the end of the bucket to a free end of the wing;

at least one hook mounted on the wing being arranged to extend over the end of the bucket adjacent the open front side of the bucket;

an aperture on the wing being arranged to receive a fastener therethrough secured to the end of the bucket; and at least one strut member arranged to be mounted at an inner end on the end of the bucket to extend laterally outward at a forward incline to an outer end mounted on the free end of the wing.

11. The combination according to claim 10 wherein there is provided a pair of the strut members mounted spaced one above the other between the end of the bucket and the free end of the wing.

12. The combination according to claim 10 wherein the wing is arranged to extend laterally outward at a forward incline from the open front side of the bucket.

13. The combination according to claim 10 wherein the wing is inclined rearwardly from a bottom end to a top end of wing in relation to the bucket.

14. An accessory in combination with a bucket of a loader having an open front side, a back side and a pair of ends, the accessory comprising:

a wing arranged to be supported on the end of a bucket adjacent the open front side of the bucket to extend laterally outward from the end of the bucket to a free end of the wing;

at least one hook mounted on the wing being arranged to extend over the end of the bucket adjacent the open front side of the bucket;

an aperture on the wing being arranged to receive a fastener therethrough secured to the end of the bucket;

at least one strut member arranged to be mounted at an inner end on the end of the bucket to extend laterally outward at a forward incline to an outer end mounted on the wing; and a wear plate comprising a rigid flange mounted along a bottom side of the wing.

15. The combination according to claim 14 wherein the wear plate projects forwardly from the wing.

* * * * *